US008672417B2

(12) United States Patent
Lever et al.

(10) Patent No.: US 8,672,417 B2
(45) Date of Patent: Mar. 18, 2014

(54) ROCK SAMPLING APPARATUS

(75) Inventors: Paul J. A. Lever, Pinjarra hills (AU); Zhiqiang Guan, Pinjara hills (AU); Muraliganesh Sivadorai, Pinjarra hills (AU)

(73) Assignee: CMTE Development Limited (AU)

( * ) Notice: Subject to any disclaimer, the term of this patent is extended or adjusted under 35 U.S.C. 154(b) by 722 days.

(21) Appl. No.: 12/524,239

(22) PCT Filed: Jan. 22, 2008

(86) PCT No.: PCT/AU2008/000071
§ 371 (c)(1),
(2), (4) Date: Jul. 23, 2009

(87) PCT Pub. No.: WO2008/089509
PCT Pub. Date: Jul. 31, 2008

(65) Prior Publication Data

US 2009/0322142 A1 Dec. 31, 2009

(30) Foreign Application Priority Data

Jan. 25, 2007 (AU) ..... 2007900392

(51) Int. Cl.
*E21C 25/14* (2006.01)

(52) U.S. Cl.
USPC ..... 299/42; 125/19

(58) Field of Classification Search
USPC ..... 299/42, 53, 54, 69, 78, 70, 75; 125/19
See application file for complete search history.

(56) References Cited

U.S. PATENT DOCUMENTS

| | | | | | |
|---|---|---|---|---|---|
| 2,216,989 | A | * | 10/1940 | St Clair | 73/864.41 |
| 3,606,470 | A | * | 9/1971 | Blum | 73/864.41 |
| 3,612,030 | A | * | 10/1971 | Blum | 125/1 |
| 4,045,088 | A | | 8/1977 | Bechem | |
| 4,372,174 | A | * | 2/1983 | Cymbalisty et al. | 73/863.11 |
| 4,718,289 | A | * | 1/1988 | Barrett | 73/863.57 |
| 5,087,102 | A | | 2/1992 | Kiefer | |
| 2003/0164174 | A1 | * | 9/2003 | Akesson Stromdahl et al. | 134/2 |
| 2004/0182960 | A1 | * | 9/2004 | Hach | 241/301 |

FOREIGN PATENT DOCUMENTS

| | | | |
|---|---|---|---|
| GB | 2 227 506 | | 8/1990 |
| SU | 1264029 | A1 * | 10/1986 |
| WO | WO 00/43637 | | 7/2000 |
| WO | WO 00/46486 | | 10/2000 |
| WO | WO 03/089762 | | 10/2003 |

* cited by examiner

*Primary Examiner* — John Kreck
(74) *Attorney, Agent, or Firm* — Merchant & Gould, P.C.

(57) ABSTRACT

The present invention uses an Oscillating Disc Cutter (ODC) in a controlled manner to cut rock for assay purposes. The ODC (1) is mounted in an elongate guide frame typically in the form of an open box channel (2). The ODC is located on a carriage (3), the carriage itself mounted on guide rails (4) within the channel (2). The apparatus includes drive means operable to drive the carriage (3) in a rectilinear manner along the rails (4) such that the rails (4) define a cutting path. The ODC cuts a groove of controlled width and depth in a rock face, yielding rock chips that can be used for accurate assay of the face.

7 Claims, 6 Drawing Sheets

ROCK SAMPLING APPARATUS

This application is a National Stage Application of PCT/AU2008/000071, filed 22 Jan. 2008, which claims benefit of Serial No. 2007900392, filed 25 Jan. 2007 in Australia and which applications are incorporated herein by reference. To the extent appropriate, a claim of priority is made to each of the above disclosed applications.

FIELD OF THE INVENTION

This invention relates to a Rock Sampling Apparatus and has been devised particularly though not solely for assaying in gold mining operations.

BACKGROUND OF THE INVENTION

Rock face sampling is used in some gold mining operations during development drifting to make operational and ore body decisions. Such sampling is typically done at the cutting face in an underground tunnel although may also be applied in above ground situations. Either way, rock sampling practices are presently done by manual techniques such as chipping the rock with a hammer and chisel which not only involve extensive manual labour but also the problem that the resultant samples can be both biased and imprecise, regardless of downstream preparation and assaying practices.

It is typically desired to take the rock samples from a channel of constant cross-section cut across the rock face as the value of the result is severely limited by the variable width and depth of the channel cut using manual techniques. This is particularly true when the samples are used for assaying.

SUMMARY OF THE INVENTION

The present invention therefore provides an apparatus for cutting rock samples from a rock face comprising an elongate guide, an oscillating disc cutter mounted for rectilinear movement along the guide, and mounting means operable to position and hold the elongate guide in a desired location relative to an adjacent rock face such that the oscillating disc cutter can be moved along the guide to cut a groove of controlled width and depth in the rock face.

Preferably the apparatus includes drive means operable to drive the oscillating disc cutter along the guide.

Preferably the mounting means include a plurality of telescopic arms mounted on the guide and extendable to engage nearby rock surfaces.

Preferably the guide includes one or more rails and the oscillating disc cutter is mounted on a carriage adapted for movement along the rails.

Preferably the rails are mounted within an elongate channel having one face open toward the adjacent rock face.

Preferably the apparatus is adapted for use in underground mines and the guide is attached to a mine vehicle by way of an adapter frame arranged to position the guide in a desired location relative to an adjacent rock face.

In a further aspect the invention provides a method of taking a rock sample for assay purposes in an underground mine including the steps of providing an apparatus of the type defined in any one of the preceding six paragraphs, positioning the guide in a desired location across a rock face to be cut, holding the guide in the desired location by operating the mounting means to engage adjacent rock walls, operating the oscillating disc cutter along the guide to cut a groove of controlled width and depth in the rock face, and collecting the rock cut from the groove for assay purposes.

In some situations the method may include the step of making a first pass across the rock face with the oscillating disc cutter positioned to cut an even path across an irregular face by removing high spots before cutting the groove along the path before the sample collection.

BRIEF DESCRIPTION OF THE DRAWINGS

Notwithstanding any other forms they may fall within its scope one preferred form of the invention will now be described by way of example only with reference to the accompanying drawings in which.

DETAILED DESCRIPTION

The apparatus according to the invention uses a downsized form of oscillating disc cutter of the type described in International Patent Application No. PCT/AU00/00066 (published as WO 00/46486) in the name of Odyssey Technology Pty Limited.

Oscillating Disc Cutting (ODC) is a novel rock cutting technology using a robust disc cutter with small amplitude of oscillation. The innovations that allow ODC to machine very strong rock with very low machine forces are illustrated in FIG. 1 and described below.

The primary innovation of the ODC is to use a disc cutter in a manner similar to a drag bit to undercut the rock. It is well known that most hard rocks are strong when loaded in compression, very strong when loaded in confined-compression, but weak when loaded in tension. In a rock cutting operation it is therefore sensible to attack the rock in a manner that causes it to fail in tension. ODC technology makes full use of the weakest character of rock by cutting rock in tension (undercutting mode); consequently it promotes tensile failure of the rock directly and therefore requires lower tool/machine forces.

A further innovation of this technology is to oscillate the disc cutter during the rock cutting operation. The disc is oscillated at small amplitude to generate cyclic loading to the rock. This facilitates the process of crack initiation and propagation in the rock by inducing fatigue cracking.

Figure 1:
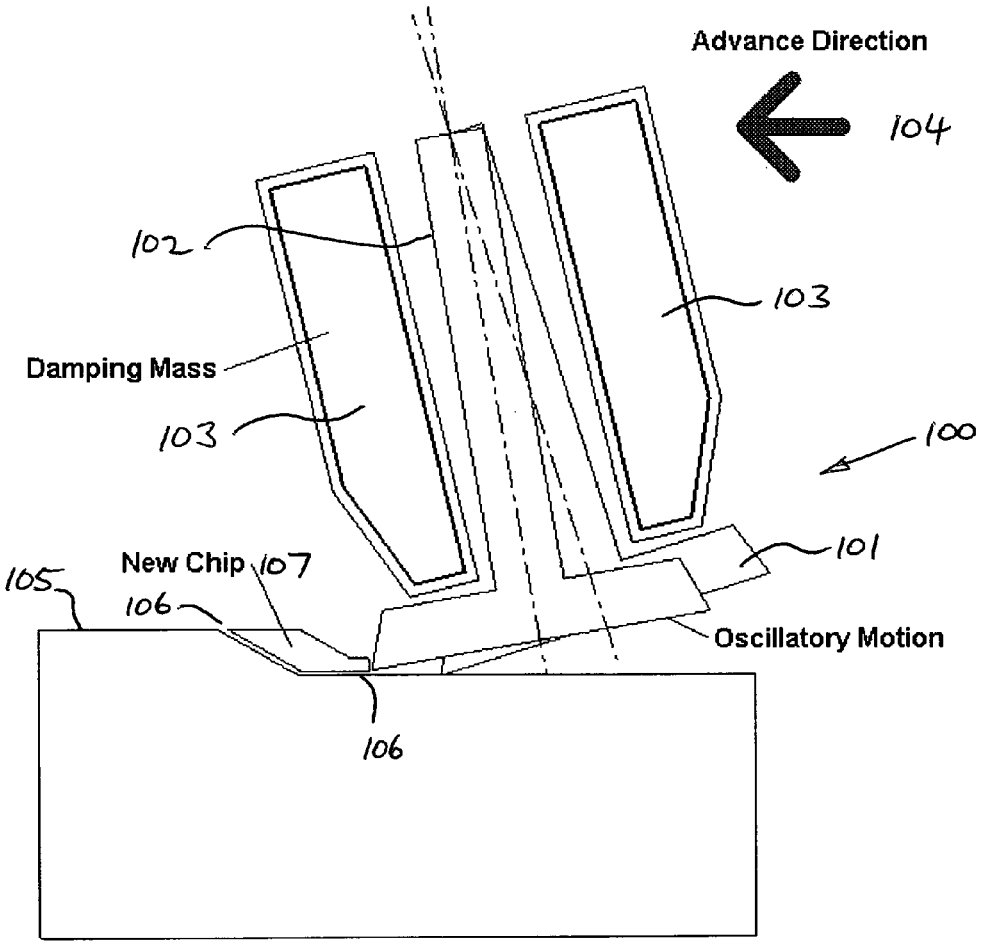
FIG. 1 is a diagrammatic cross-sectional elevation through an oscillating disc cutter of the type used in the present invention.

FIG. 1 shows a schematic view of an ODC 100 in operation. The ODC includes a disc cutter 101 mounted on a drive shaft 102, and a inertial damping mass 103. The cutter is advanced in the direction shown by arrow 104 to cut rock from rock face 105. By employing an undercutting action and oscillatory motion, the cutter facilitates crack 106 formation breaking off a rock chip 107. Water jets (not shown) may be used to cool and lubricate the cutter as well as clearing the rock chips and dust.

The present invention provides that by using an Oscillating Disc Cutter (ODC) in a controlled manner to cut rock for assay purposes, it is possible to obtain very accurate rock samples that are not possible to obtain by conventional manual techniques.

Figure 2:
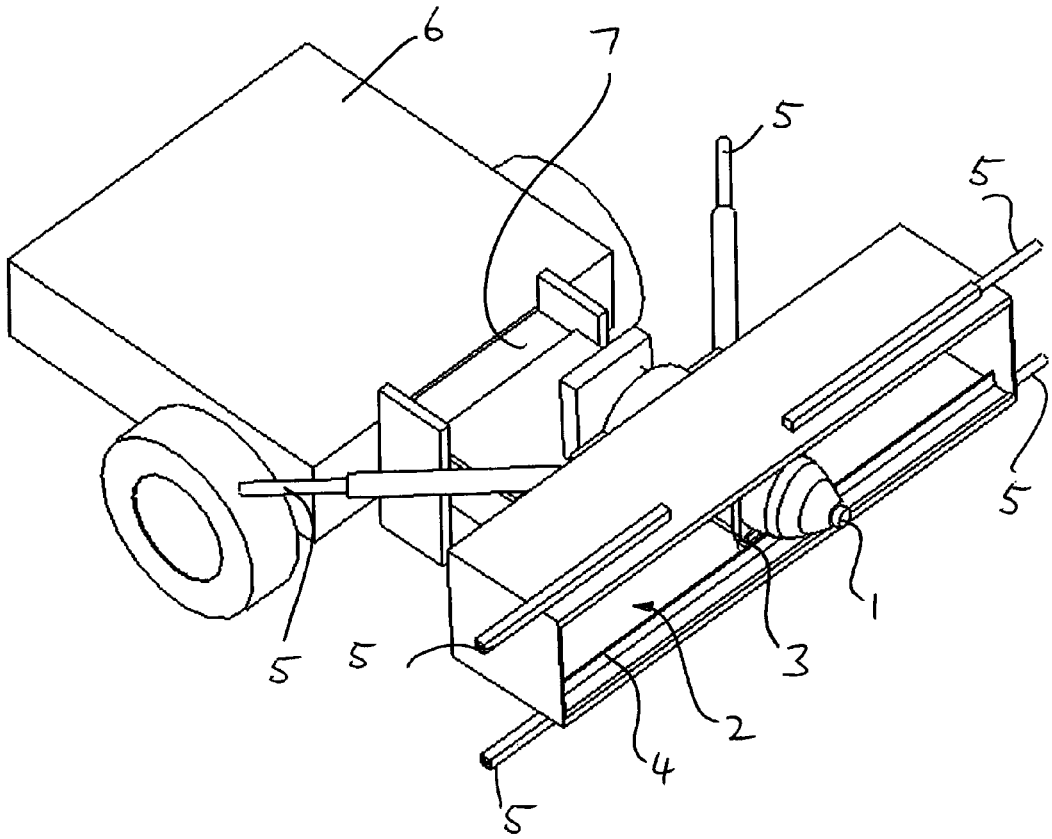
FIG. 2 is a diagrammatic perspective view of rock sampling apparatus according to the invention mounted on a wheeled vehicle.

The ODC 1 (FIG. 2) is therefore mounted in an elongate guide frame 2 typically in the form of an open box channel. The ODC is located on a carriage 3, the carriage itself mounted on guide rails 4 within the guide frame.

The apparatus also includes drive means (not shown) operable to drive the carriage 3 in a rectilinear manner along the rails 4 such that the rails 4 define a cutting path.

Whilst the invention maybe adapted for above ground operation, in this embodiment it is depicted in a form suitable for underground operation and is therefore provided with bracing means in the form of a number of arms 5 mounted on the guide frame 2 and extendable to engage nearby rock surfaces.

The box channel is attached to a mine vehicle diagrammatically shown at 6 by way of an adaptor frame 7 arranged to position the guide frame 2 in a desired location relative to an adjacent rock face, which it is desired to cut.

In use, this apparatus, which forms a rock sampler, is driven to the face to be sampled on a vehicle such as a load haul dump (LHD) or similar type of mining vehicle. When the sampler is driven to the face, the apparatus will be rolled out of the truck at the position shown in FIG. 2. Once it is in this position, the guide frame 2 can be moved up or down to the required height (according to the height of ore body) and rotated to any orientation in order to take a sample normal to the dip angle of the lode. Before making the cut, the arms 5 are extended against the surrounding rock surfaces to positionally secure the guide frame 2.

Figure 3:
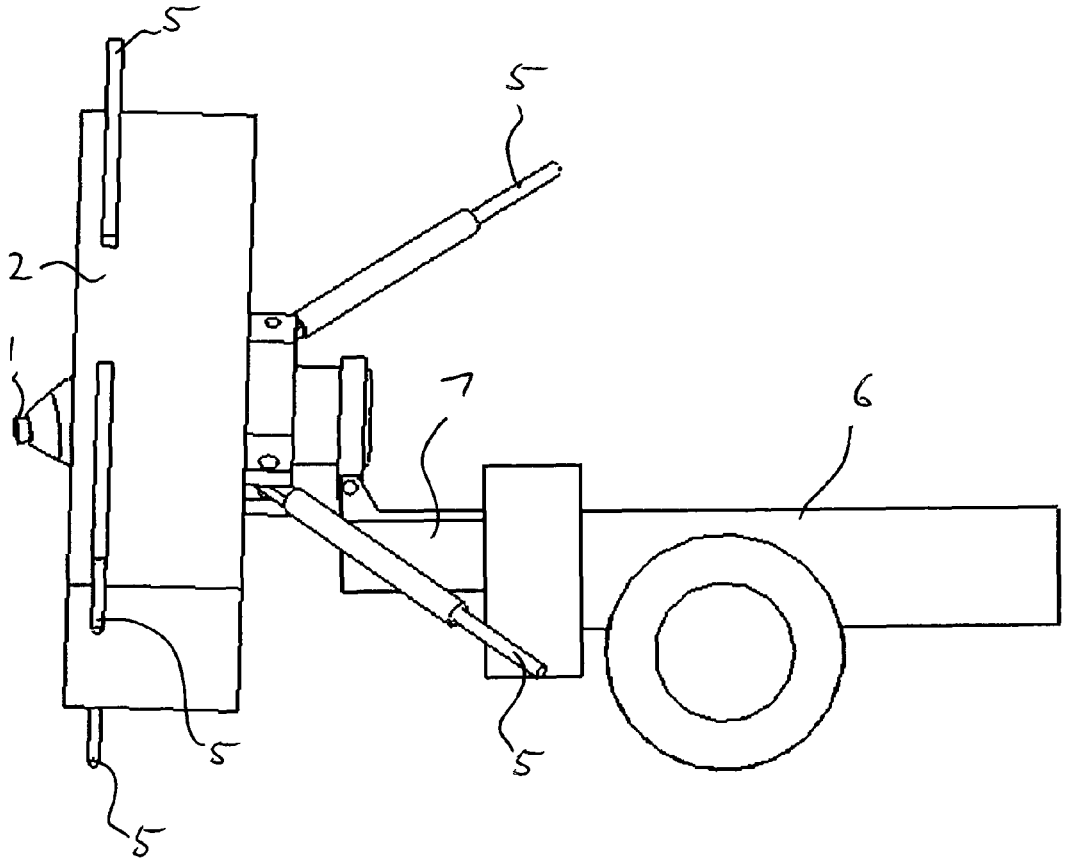
FIG. 3 is a side view of the apparatus shown in FIG. 2.

The ODC cutting head 1 is typically attached to the back of a truck with an adaptor frame 7 as seen from the side view shown in FIG. 3. This adaptor frame can be raised up and down by either gear-track mechanism or by hydraulic cylinder option (not shown).

The disc cutter and its oscillating system typically includes a motor, an oscillating shaft, a disc cutter and bearings. A damping mass is also included in the cutting head to lower the dynamic forces experienced by the carrier as shown in FIG. 1.

Figure 4:
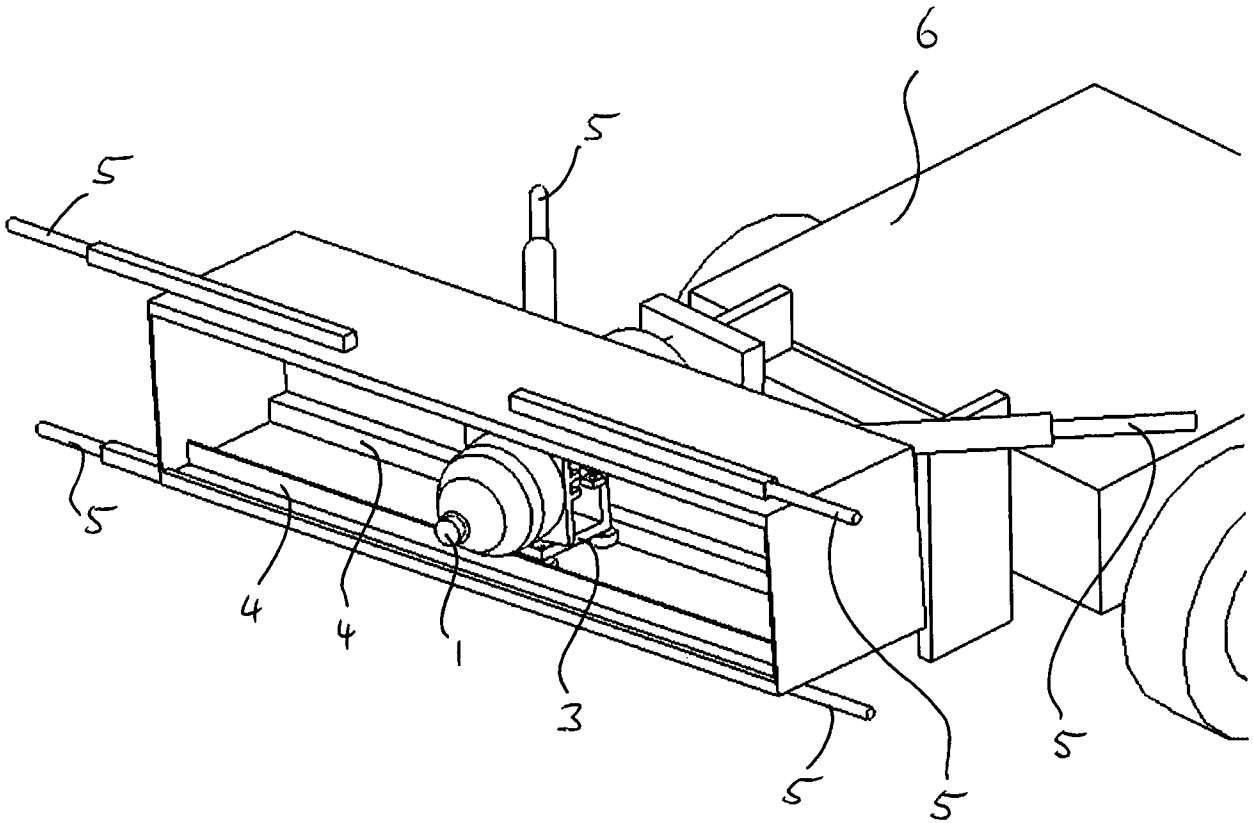
FIG. 4 is a frontal perspective from a different viewpoint of the apparatus shown in FIG. 2.

The cutter 1 and carriage 3 travel along guide rails 4 as shown in FIG. 4. The guide rails may be curved at one end (not shown) to provide the ODC sampler with an initial curved cutting path such that each cut may be commenced on a flat face without any starting lip at an appropriate rake angle. The carriage 3 is typically driven by a motor with a rack and pinion gear linear drive. However, other linear drive systems may be used to move the carriage 3 including chain drives, screw drives or hydraulic actuators.

Attached to the elongate guide frame are a number of telescopic arms 5 in the form of hydraulic cylinders, which have two major functions: (i) support the guide frame and (ii) adjust the position of the frame. In the embodiment depicted, six telescopic arms 5 utilised, although it should be appreciated that there may be more or less than six telescopic arms, without departing from the scope of the invention. Once the guide frame is located in the correct position, the six cylinders are extended to the side rock surfaces of the heading and support the track frame. These cylinders absorb all the cutting tool forces so there are no forces transmitted back to the truck or other support vehicle. Differential extension of the side cylinders can be used to adjust the position of the track frame. In this way, sampling can occur in different heading sizes. The cylinders have limited extension length which can only cover certain different heading sizes. Should large variation of heading sizes be required (such as covering from 2×2 m to 6×6 m heading sizes), different supporting frames can be used without any modification on the cutting head.

In an alternative form of the invention the elongate guide may be mounted on a universal arm 8 (FIG. 5) which typically is a jointed arm having pivots at 9 and 10 to enable universal movement of the guide frame 2 when the proximal end 11 of the arm is attached to a support vehicle such as a LHD or similar type of mining vehicle.

Figure 5:
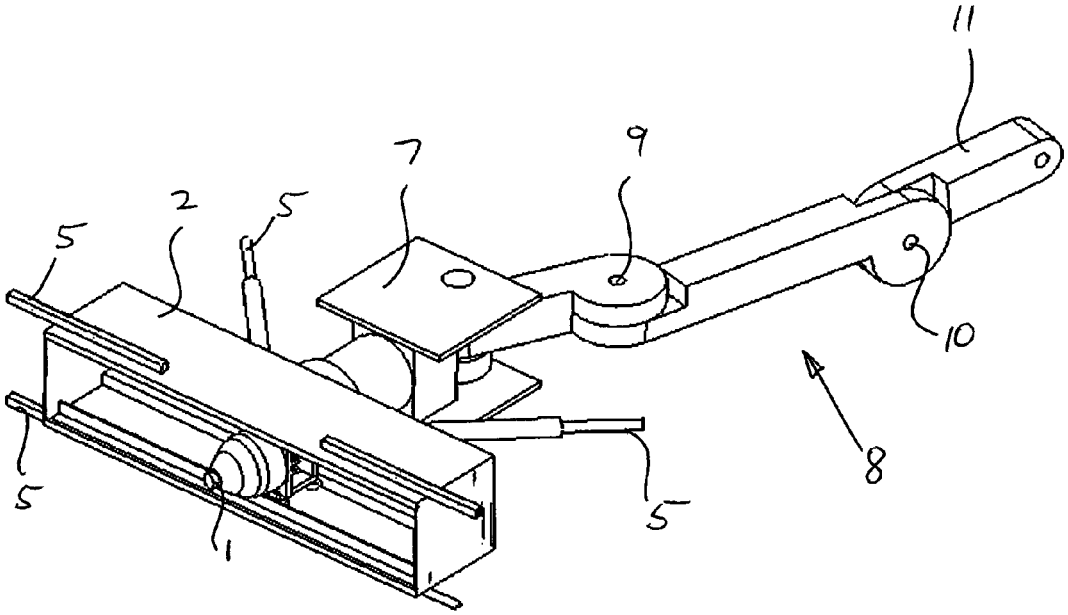
FIG. 5 is a diagrammatic perspective view of apparatus according to the invention using an alternative mounting arm.

At the face, the ODC cutting head is positioned from the truck at the position shown in FIG. 5. The universal arm can move the guide frame up and down, left and right to locate the cutting head at any required location. Once the location has been set, the guide frame can be rotated through 360 degrees so that the sample can be taken normal to the dip angle of the lode. Once the required position and orientation have been set, the six telescopic arms 5 extend against the sides of the heading to rigidly locate the guide frame 5. Now the cutting tool is ready to take a rock sample.

Figure 6:
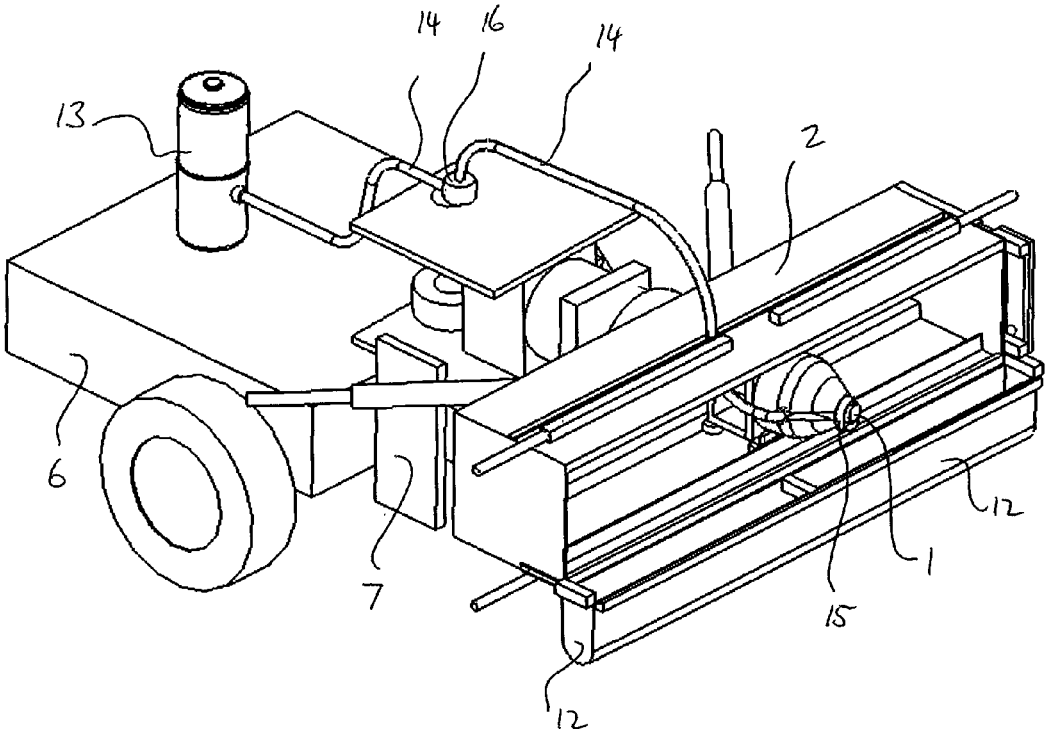
FIG. 6 is a diagrammatic perspective view, similar to FIG. 2 in combination with a bag or vacuum system for gathering rock samples.

The rock sample cut by the oscillating disc cutter may be collected in any convenient manner such as with a system similar to a long slot cloth bag 12 (FIG. 6) which is mounted directly under the guide frame 2 and positioned to catch rock chips falling from the ODC cutting head 1.

As an alternative (or adjunct) to collecting the rock samples in bag 12, the apparatus may be provided with a vacuum system having a vacuum motor and receptacle 13 fed through a vacuum tube 14 from a nozzle 15 located around or adjunct to the ODC cutting head 1. The vacuum tube 14 may be either flexible or rigid and provided with a swivel 16 permitting movement in the tube 14 as the guide frame 2 is manoeuvred into position.

In use, once the guide frame 2 has been located in the desired orientation parallel to the face to be sampled, and securely locked into position by operating the six telescopic arms 5 to engage the sides of the heading adjacent the face, the ODC cutting head is activated and moved along a rectilinear path cutting a groove of even width and depth in the rock face.

Where the rock face is uneven, the ODC may first be used to make a pass across the rock face positioned to cut an even path across an irregular face by removing high spots from the face. The ODC may then be set to a greater depth to cut the required groove of constant depth along the path previously cut in the prior pass.

By collecting the rock cuttings made only from the cutting of the controlled cross-section groove by the oscillating disc cutter it is possible to obtain a sample of the requisite volume and composition required to accurately assay the rock exposed in the face.

By mounting the apparatus according to the invention on an underground mining vehicle, the sampling can be done quickly and without unnecessary disruption to the mining operation. This is important in most mining situations where there may be only a short time window for taking the necessary samples.

A further advantage of the present invention over existing methods is the safety factor achieved by limiting the time that personnel or equipment need to be exposed in the dangerous area adjacent the rock face which may be in advance of any roof bolting operations.

The claims defining the invention are as follows:

1. A method of taking a rock sample for assay purposes in an underground mine including the steps of:

providing an apparatus for cutting rock samples from a rock face, the apparatus including an elongate guide; an oscillating disc cutter mounted for rectilinear movement along the guide; and a mount operable to position and hold the elongate guide in a desired location relative to an adjacent rock face such that the oscillating disc cutter can be moved along the guide to cut a straight groove of controlled width and depth in the rock face;

positioning the guide in a desired location across a rock face to be cut;

holding the guide in the desired location by operating the mount to engage adjacent rock walls;

operating the oscillating disc cutter along the guide to cut a groove of controlled width and depth in the rock face; and collecting the rock cut from the groove.

2. A method according to claim 1 including the step of making a first pass across the rock face with the oscillating disc cutter positioned to cut an even path across an irregular face by removing high spots before cutting the groove along the path for the sample collection.

3. A method according to claim 1 wherein the apparatus further includes a drive operable to drive the oscillating disc cutter along the guide.

4. A method according to claim 1 wherein the mount includes a plurality of arms mounted on the guide and extendable to engage nearby rock surfaces.

5. A method according to claim 1 wherein the guide includes one or more guide rails and the oscillating disc cutter is mounted on a carriage adapted for movement along the rails.

6. A method according to claim 1 wherein the rails are mounted within an elongate channel having one face open toward the adjacent rock face.

7. A method according to claim 1 wherein the guide is attached to a mine vehicle by way of an adapter frame arranged to position the guide in a desired location relative to an adjacent rock face.

* * * * *